US007448816B2

(12) United States Patent
Killion

(10) Patent No.: US 7,448,816 B2
(45) Date of Patent: Nov. 11, 2008

(54) DISPLAY INSERT CONTAINING WRITING INSTRUMENT

(76) Inventor: Thomas Killion, 5534 Woodacre Ct., Indianapolis, IN (US) 46234

( * ) Notice: Subject to any disclaimer, the term of this patent is extended or adjusted under 35 U.S.C. 154(b) by 856 days.

(21) Appl. No.: 10/918,635

(22) Filed: Aug. 13, 2004

(65) Prior Publication Data

US 2005/0057536 A1 Mar. 17, 2005

Related U.S. Application Data

(60) Provisional application No. 60/497,948, filed on Aug. 25, 2003.

(51) Int. Cl.
*B43K 29/00* (2006.01)

(52) U.S. Cl. ..... 401/195

(58) Field of Classification Search ..... 401/52, 401/195; 40/334, 335
See application file for complete search history.

(56) References Cited

U.S. PATENT DOCUMENTS 4,028,540 A 6/1977 Key et al.
D300,833 S * 4/1989 McShirley ..... D19/46
5,544,437 A * 8/1996 Lanoie ..... 40/334
5,673,996 A 10/1997 Ducker
6,045,281 A * 4/2000 Bunn et al. ..... 401/195
6,328,493 B1 * 12/2001 Starchevich ..... 401/6
6,773,191 B2 * 8/2004 Killion ..... 401/195

FOREIGN PATENT DOCUMENTS

GB 1118069 A 6/1968
GB 1581835 B1 12/1980
GB 2212449 A 7/1989

* cited by examiner

*Primary Examiner*—David J Walczak
(74) *Attorney, Agent, or Firm*—E. Victor Indiano; Indiano Vaughan LLP

(57) ABSTRACT

A writing instrument includes a colorant dispensing tip and a barrel. The barrel has a proximal portion and a distal portion. The proximal portion includes a hand-engaging surface and a proximal end coupled to the colorant dispensing tip. The distal portion is unitarily formed with the proximal portion and includes a distal end. The distal end is joined to the proximal portion to form a display card receiving closed hoop. A display card is sized and configured for being received by the hoop.

20 Claims, 5 Drawing Sheets

DISPLAY INSERT CONTAINING WRITING INSTRUMENT

I. PRIORITY STATEMENT

This application claims priority to Thomas Killion, U.S. Provisional Application No. 60/497,948, that was filed on 25 Aug. 2003.

II. FIELD OF THE INVENTION

The present invention relates to writing instruments, and more particularly, to decorative writing instruments. Most particularly, the present invention relates to a novel writing instrument of the type that contains a card-like display unit upon which a message can be written, and the process by which such a writing instrument is made.

III. BACKGROUND OF THE INVENTION

Writing instruments, such as pens, pencils and the like have an elongated tubular shape. The tubular shape can have any one of a variety of cross-sectional configurations, including circular, hexagonal, triangular or the like. Anyone who has ever visited a stationery store, walked down the school supply aisle of a mass merchandiser, or spent time in an office supply store recognizes that writing instruments such as pens and pencils exist in a wide variety of shapes and sizes, and also recognizes that most writing instruments are primarily linear in their configuration.

Back in the mid-1980s, the Applicant invented a writing instrument that was bent into decorative shapes. These decorative shapes were achieved by starting with a standard, linear pen or pencil that was made from a thermo-formable material. In this regard, standard pencils were not useable, since most pencils contain a wood casing that is not readily bendable or shapeable under the influence of heat. The Applicant heated one end of the thermo-formable, generally linearly writing instrument to a point wherein the material from which the body of the instrument was made was "soft" and pliable enough to be bendable, and thereby formable into a decorative portion.

The Applicant found that an interiorly residing mold-type device could be used as a template around which to bend the heated and pliable writing instrument to form the writing instrument into a desired shape that was consistent from instrument to instrument. Among the first shapes that the Applicant made was a pencil having an eraser (distal) end portion that was formed into a shape that resembled a heart. The finished pencil had a heart-shaped top portion, and a generally linearly extended bottom (proximal) portion that was capable of being sharpened, gripped by a user and employed as a conventional writing instrument.

Although the Applicant first employed his invention with pencils, he later found that stick-type pens could also be employed to create pen-type writing instruments having decorative shapes. The Applicant found, through experimentation, that the best results were achieved by employing elongated stick-type pens that had a length longer than a standard stick pen, so that the final product would comprise a pen having a normal length linear portion to which was added the decorative head portion.

In the ensuing years, the Applicant has employed a wide variety of molds to create a wide variety of shapes, that include shapes as diverse as hockey sticks, alligators, T-shirts, numerals, sharks, pets and inanimate objects. A sampling of the variety of shapes that the Applicant has employed in his decorative writing instruments can be viewed at www-.bentcil.com.

One type of pen having a decoratively-shaped head the Applicant sells is a display insert-containing writing instrument. The display insert-containing writing instrument is a writing instrument wherein the decorative head portion includes a shaped hoop portion. A generally planar card-like display insert is captured by the radially inwardly facing surface of the hoop portion. The hoop can assume any number of a variety of shapes, such as the shape of a frog, a circular shape, a shark-like shape or the like. The display insert comprises a shaped plastic card on which is printed a picture or a message, such as a picture of a flag, a picture of a frog, or a message such as "I love you". Once printed, the card stock is laminated with a plastic coating to improve the aesthetic appearance of the card and its durability.

Prior to the instant invention, such display insert-containing writing instruments were produced by the Applicant. An example of such prior art display-containing writing instrument is the flag-shaped writing instrument 10 that is shown in FIGS. 1 and 2, and that will be described below.

Turning now to FIGS. 1 and 2, prior art writing instrument 10 is shown as being formed from a unitary pen barrel 12, that includes a generally linear lower portion 13.

A decoratively shaped head portion 16 is disposed at the proximal end of the writing instrument 10. The decoratively shaped head portion 16 is planarly hoop-shaped to enclose a planar, card-like display insert 20 having a front face 21 on which a first message design or picture can be displayed, and a rear face 23 on which a second message or picture can be displayed. The second message or picture can be identical to the first message or picture shown on the front face 21.

A colorant (e.g. ink) dispenser tip 18 is disposed adjacent to the proximal end 19 of the pen barrel 12. Preferably, the ink dispenser tip 18 is coupled to an ink containing cartridge (not shown), that is usually cylindrical in shape, and is disposed within the hollow interior of the pen barrel 12. The ink cartridge (not shown) is fluidly coupled to the ink dispensing tip 18, so that ink from the cartridge can flow through the ink dispensing tip 18, and thereby can be dispensed on a writing surface, such as a sheet of paper, by an ink dispensing member that is a component of the ink dispenser.

The ink dispensing member usually comprises a ball, of a ballpoint-type pen. Alternately, it may comprise a gel applicator, felt-tip ink dispenser or nib for a fountain or cartridge type pen. Ink dispenser 18 includes a radially outwardly facing surface that is compression or press-fit into the pen barrel 12, so that the radially outwardly facing surface of the ink dispenser 18 is securely and snugly received by the radially inwardly facing surface of the pen barrel 12 that defines the hollow passageway therethrough.

The distal end of the pen barrel 12 terminates at a distal end 24. Importantly, in the prior art device, the distal end 24 of the pen barrel 12 is not connected to the adjacent portion of the pen barrel, thereby defining a gap 25 that exists between the distal end of the pen barrel 12 and the adjacent portion of the pen barrel.

As discussed above, the head portion 16 forms a generally ring-like hoop, that in the prior art embodiment shown in FIG. 1 takes a shape of a flag. The distally disposed head portion 16 includes an outwardly facing surface 22 that faces generally radially outwardly and a radially inwardly facing surface 26. When the device is formed, the radially inwardly facing surface includes a perimetral groove 30 for receiving the edges of the display, such as the top edge 32, and the bottom edge 34.

In order to form the prior art pen shown in FIGS. 1 and 2, a generally linearly extending, cylindrical pen barrel 12 is provided. The distal portion of the pen barrel 12 is inserted into a heater to heat the distal portion of the pen 10 to a point wherein the head portion 16 is bendable. The head portion 16 is then wrapped around an interior mold having a shape generally similar to the shape of the head portion 16. The interior mold includes a raised ridge or bead, so that when the head portion 16 is wrapped around the interior mold, the groove 30 is formed in the radially inwardly facing surface 26. The exterior mold is then applied against the exterior surface to cause it to become flattened, and to cause the head portion to press tightly against the interior mold to thereby form a distinct shape.

In this process, the inwardly facing surface 26 and outwardly facing surface 22 become flattened from their prior cylindrical shape. This causes an interior cavity to take on a relatively flattened oblong configuration, that differs from the original cylindrical configuration of the generally linear pen barrel 12. When so formed, the interior of the portion 16 is sized to have an interior area that is slightly smaller than the area of the display card 20.

To attach the display card 20 to the pen 10, the distal end 24 of the pen is pulled outwardly, and the display card 24 is inserted in the groove 30. Because the plastic of the head portion 16 of the pen barrel has memory, and since the area of the head portion 16 is smaller than the area of the display unit 20, the distal end 24 of the pen springs back when released, to engage the display unit 20. Due to the relatively over-sized nature of the display unit 20, the display unit 20 is held within the interior hoop of the head portion 16 by the spring force exerted by the head portion 16 of the barrel 12.

Although the above-referenced pen and the process of making it serve to create a very useful and attractive device, room for improvement exists. In particular, room for improvement exists in providing a device and method that overcomes some of the problems that were experienced during the manufacture of the pen.

One difficulty that was experienced was forming the groove 30. During the process by which the head portion was bent around the interior mold, it is important to maintain the head portion in a planar relationship. Often, this was difficult to achieve. When the pen was formed, if the head portion 16 was not formed in a manner wherein it was almost perfectly planar, portions of the groove would be linearly off-set from each other. This results in the plane of the display unit 20 being formed so that it was not parallel to the major planes of the head portion 16. Viewed another way, an off-setting of the grooves 30 in different portions of the groove would cause display unit 20 to become not perfectly perpendicular to the inwardly facing surface 26 of the head portion 16.

In some cases, the head portion 16 would assume a wave-like configuration, that detracted significantly from the appearance of the pen. In particular, the head portion 16 could look uneven, disproportionate, and non-controlled.

Another difficulty in forming a pen according to the prior art springs from the required depth of the groove. In order to appropriately seat and retain the display unit card 20, the groove had to have a certain depth sufficient to receive the edges, 32, 34 of the display unit sufficiently deeply so that the display unit 20 would not become disengaged from the head portion 16.

In order to make a groove having a significant depth, the manufacturer was forced to ensure that thickness 'T' (FIG. 2) of the head portions was large enough to accommodate a groove of the desired and necessary depth. Unfortunately, using head portion 16 with a thickness T made it difficult to form portions having complex shapes, since the thickness reduced the ability of the manufacturer to form bends and curves having small radii of curvature. This difficulty was often experienced when complex shapes, such as, for example, outlines of the state of Texas, or an outline of the United States were made. Although such shapes were formable, the ability of the manufacture to define curves and bends that are desirable to best represent such complex designs were significantly limited.

A third difficulty experienced with this particular process results from the use of a gap between the distal end of the pen 24 and the adjoining portion of the pen barrel. The spring held nature of the head portion 16 (as discussed above) tended to hold the display units in place. However, the types of shapes that could be formed were often limited by the nature of the shape, as some shapes did not lend themselves securely holding the display unit in place. This difficulty was caused by the hinging movement of the head portion, and expansion of the plastic pen material that would occur because of changes in temperature. In more intricate designs, dimension changes that did occur, would make it more difficult to form a "spring fit" that was engineered well enough to securely and reliably hold the insert in place. For example, if the interior of the head portion 16 "hoop" were too large, the display unit would often rattle within the unit. Additionally, inconsistencies during the manufacture of making each unit exactly alike caused similarly shaped hoops to often have gaps of different sizes, thus detracting from a consistent appearance of the products, and detracting from the overall attractiveness of the products.

It is therefore one object of the present invention to provide a device that overcomes the problems discussed above, and that results in a product having the desired aesthetic characteristics.

IV. SUMMARY OF THE INVENTION

In accordance with the present invention, a writing instrument comprises a colorant dispensing tip and a barrel. The barrel has a proximal portion and a distal portion. The proximal portion includes a hand-engaging surface and a proximal end coupled to the colorant dispensing tip. The distal portion is unitarily formed with the proximal portion and includes a distal end. The distal end is joined to the proximal portion to form a display card receiving closed hoop. A display card is sized and configured for being received by the closed hoop.

Preferably, the hoop portion includes a radially inwardly facing display unit engaging surface that includes a relatively thicker portion, a relatively thinner portion, and a step portion disposed between the relatively thicker portion and the relatively thinner portion. The radially inwardly facing surfaces are sized and configured for receiving the display unit in a snug relation, wherein the display card abuts against the step portion.

These and other features of the present invention will become apparent to those skilled in the art upon a review of the drawings presented below, along with the description set forth below that describes the best mode of practicing the invention perceived presently by the Applicant.

V. BRIEF DESCRIPTION OF THE DRAWINGS

VI. DETAILED DESCRIPTION

Figure 3:
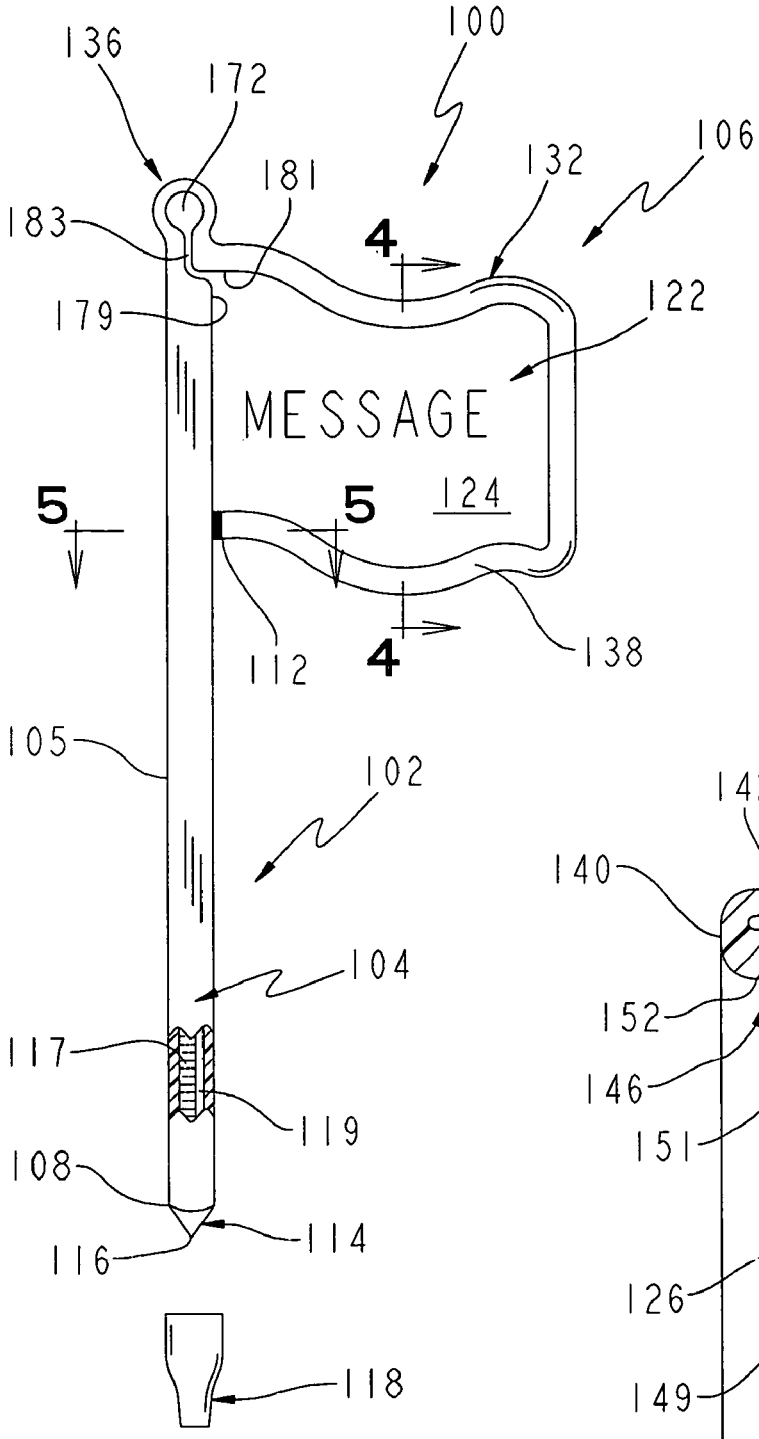
FIG. 3 is a plan view, partly broken away, of a writing instrument of the present invention.
Figure 4:
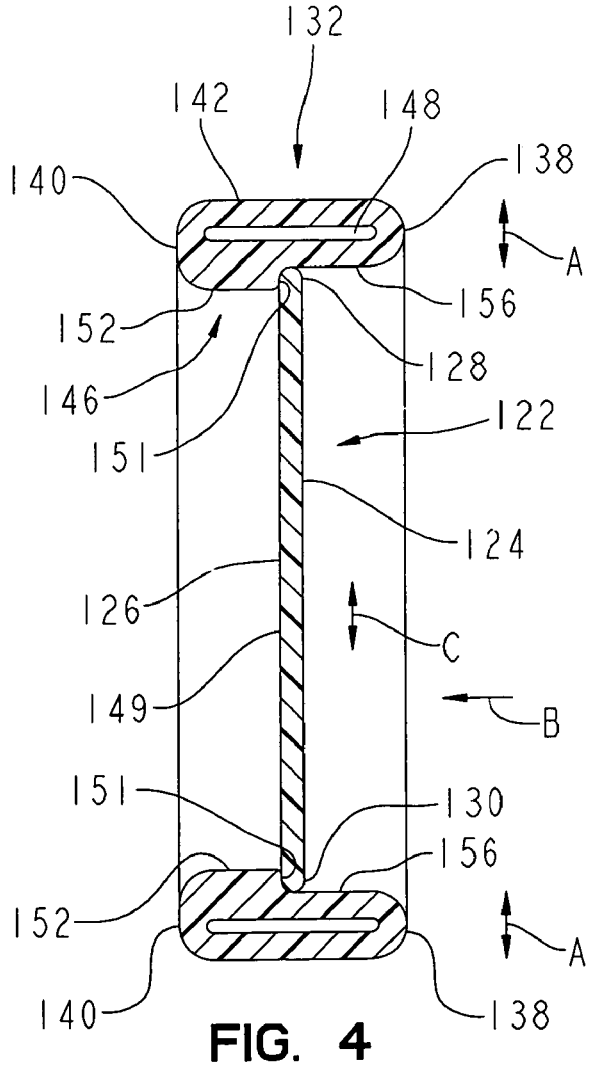
FIG. 4 is a greatly enlarged, sectional view taken generally along line 4-4 of FIG. 3.
Figure 5:
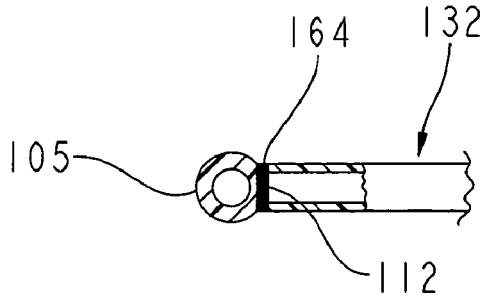
FIG. 5 is an enlarged, sectional view taken along lines 5-5 of FIG. 3.

A display unit containing writing instrument 100 of the present invention is shown in FIGS. 3-10. Turning first to FIGS. 3-5, the writing instrument 100 includes a pen barrel 102 that has a generally linearly extending lower portion 104, that, in the preferred embodiment, is generally cylindrical in shape, and that includes a radially outwardly facing cylindrically shaped hand-engaging surface 105. For purposes of directional conformity within this application, the linear portion 104 will be arbitrarily considered to comprise the proximal portion of the pen, and the head portion 106 will be denominated as the "distal portion" of the pen 100.

A decoratively shaped head portion 106 is disposed at the distal end of the writing instrument 100. In the embodiment shown in FIG. 3, the head portion 106 is shaped to resemble the outline of a waving flag. However, it will be understood that the head portion 106 can assume a very wide variety of shapes, depending upon the desires of the manufacturer and customer. Examples of such shapes that the head portion 106 can assume are shown at www.bentcil.com. On this web site, shapes exist that include among other things, woodland creatures, alligators, ambulances, outlines of states and nations, flower baskets, artists' pallets, sports instruments, such as basketballs and hockey sticks, clocks, postage stamps, diamonds, rings, rectangles, triangles, ovals, bowling pins, books, beer bottles, bread slices, coffee cups, computers, pills, cornucopias, fish, fire trucks, ears, dog heads, balloons, animals, light bulbs, microphones, pentagons, hats, pumpkins, sea shells, stop signs, suns, telephones and televisions.

The writing instrument 100 includes a proximal end 108 and a distal end 112. As will be explained in more detail below, the writing instrument 100 is preferably formed from a unitary, cylindrically tube-shaped, linearly extending blank, having two ends which, in the finished writing instrument 100 become the proximal end 108 and the distal 112. A colorant dispenser, such as a ballpoint type ink dispenser 114 is fixedly coupled to the proximal end 108 of the pen through a press fit or friction fit arrangement.

The ink dispenser 114 includes an ink dispensing tip 116, that, in the embodiment showing the drawings, comprises a ballpoint type ink dispenser. Alternately, the ink dispensing tip 116 can comprise a nib of a cartridge pen, a rolling ball of a roller ball-type pen, a gel dispenser, a felt tip or even a pencil lead of the type found in a mechanical pencil. In the ballpoint pen type embodiment shown in FIG. 3, the tip 116 is coupled to a generally cylindrical, linearly extending ink cartridge 117, that is disposed interiorly within the hollow interior cavity 119 of the pen barrel 102.

Figure 9:
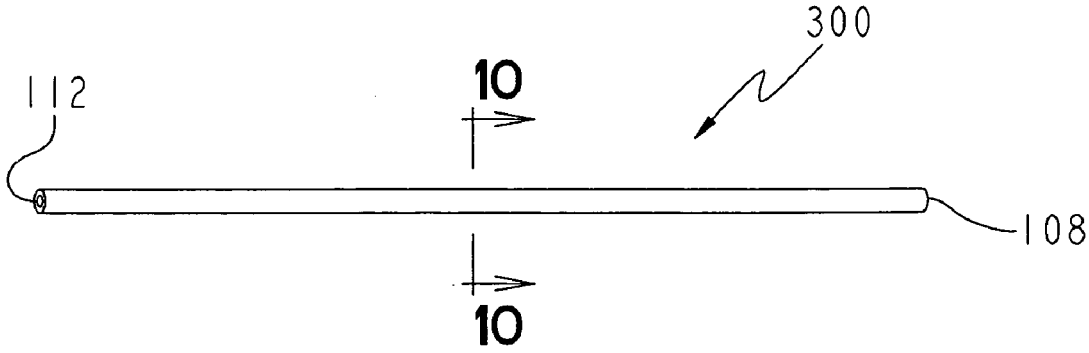
FIG. 9 is a plan view of a writing instrument barrel blank that is used to form the writing instrument of the present invention.
Figure 10:
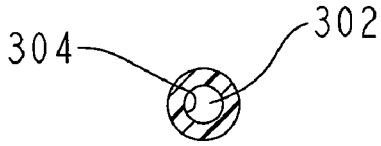
FIG. 10 is an enlarged, sectional view taken along lines 10-10 of FIG. 9.

As is best shown in FIGS. 9 and 10, the blank 300 from which the writing instrument 100 is made comprises a generally linearly extending cylindrical tube having a proximal end 108, a distal end 112, and a hollow interior passageway. The blank 300 includes a constant cross sectional shape throughout its length so that the blank 300 can be produced by an extrusion process. The hollow interior cavity 302 extends along the length of the blank and includes a cylindrical interior wall 304 that defines the hollow cylindrical cavity 302. In the finished writing instrument 100, the generally linear lower portion 104 has a shape and cross sectional configuration generally unchanged from that of the blank 300 shown in FIGS. 9 and 10.

Returning back to FIGS. 3-5, the decoratively shaped head portion 106 comprises a closed hoop for containing and holding a card-like display unit 122 having a front face 124 on which a first message can be placed, and rear face 126 on which a second message can be placed. As shown in the www.bentcil.com web site, the message can take one of any number of forms. For example, the message can take the form of a photograph, a written message, an artistic depiction or the like.

One particularly useful form that the message can take is that of an advertising message to promote the products or services of a product or service provider. In this regard, the Applicant has found that many people purchase display unit containing pens as part of an advertising specialty program. The writing instruments are given by purchasers to their customers and potential customers, so that the customers, by keeping and using the writing instrument, will be reminded of the product and/or service provider. The message depicted on the front face 124 is usually similar to the message displayed on the rear face 126, although the two can be different. As shown in FIG. 4, the display unit 122 includes an upper edge 128 and a lower edge 130, along with two side edges (not shown) that are sized and configured for engaging the display unit engaging hoop portion 132.

The head portion 106 includes a display unit engaging hoop portion 132, that extends perimetrally around the edges of the display unit 124 to hold and contain the display unit 122 along substantially all of the entire perimetral edge surface of the display unit 122. The head portion 106 of the particular embodiment shown in FIGS. 3-5 also includes an ornamental loop portion 136 that is provided primarily for ornamentation, as the ornamental loop portion 136 does not engage or hold the display unit 122. The display unit engaging hoop portion 132 is unitary in construction. As will be described in more detail below, the hoop portion 132 is formed from the single, generally linear pen barrel blank 300, shown in FIG. 9.

Returning back to FIGS. 3 and 4, the display unit engaging hoop portion 132 includes a first (front) side surface 138, a second (rear) side surface 140. Additionally, the display unit engaging hoop portion 132 includes a generally radially outwardly facing surface 142, and a radially inwardly facing surface 146. Radially inwardly facing surface 146 engages the edges e.g. 128, 130 of the display unit 122.

Figure 2:
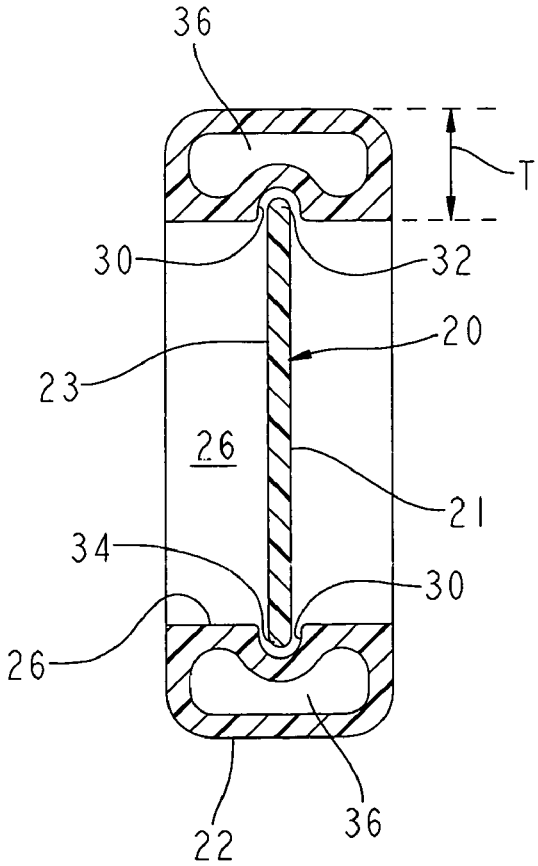
FIG. 2 Prior Art
FIG. 2 is a sectional view of a prior art pen, taken along lines 2-2 of FIG. 1.

As shown in FIG. 4, the display unit engaging hoop portion 132 is flattened and thin, to cause the interior cavity 148 to be compressed to the point wherein it comprises little more than a very thin slit wherein the opposed walls of the slit may actually contact each other. When compared to the prior art device, the display unit engaging hoop portion 132 can be made much more thinly, when measured in a direction indicated generally by arrows A of FIG. 4. This enhanced thinness is achieved largely through the manner in which the radially inwardly facing surface 146 engages the edges 128, 130 of the display unit that obviates the need for the continuous groove 30 that is formed in the prior art device (FIG. 2).

Figure 4A:
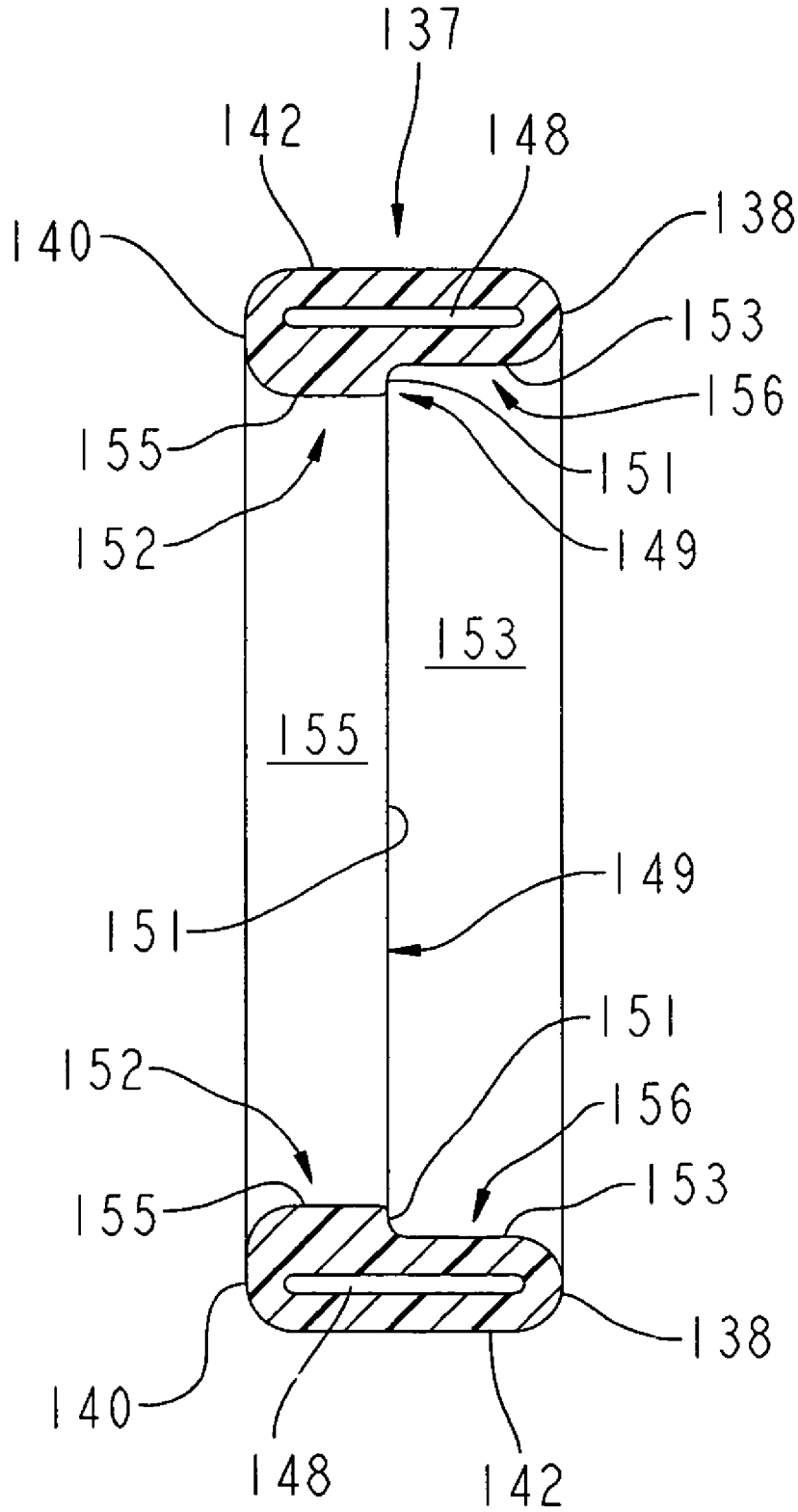
FIG. 4A is a greatly enlarged sectional view, similar to FIG. 4, but with the display unit removed.

The radially inwardly facing surface 146 includes a relatively thicker, raised portion 152 that is disposed adjacent to the second rear side surface 140, and a relatively thinner, recessed portion 156 that is disposed adjacent to the first (front) side surface 138. A perimetrally extending lip portion 149 is formed at the position, on the radially inwardly facing surface 146, where the relatively thicker portion 152 meets the relatively thinner portion 156. As best shown in FIG. 4A, the perimetrally extending lip portion 149 includes a generally axially facing surface 151 that divides the radially inwardly facing surface 146 into relatively larger diameter radially inwardly facing surface portion 153 that is disposed adjacent to the first side surface 138; and a relatively smaller diameter radially inwardly facing surface 155 disposed adjacent to the second side surface 140.

As is shown in FIG. 4, the display unit 122 is sized so that it can be inserted into the hoop in a direction indicated generally by arrow "B", since the distance between opposed relatively thinner 156 portions of the radially inwardly facing surface 146 is equal, or just slightly greater than the height of the display unit 122, measured in a direction indicated generally by arrows "C".

The same general relation holds true with respect to the side edge surfaces of the display unit, and the opposed thinner portions 156 of the side portions of the radially inwardly facing surface 146 of the hoop 132. The display unit 122 is pushed into the hoop 132 in a direction indicated by arrow "B", so that its edges move along surfaces 153, until the edges 128, 130 reach a point wherein further movement is prevented due to the edges 128, 130 encountering the axially facing surface 151 of perimetrally extending lip portion 149. By contrast, the separation distance between opposed surfaces 155 of the relatively thicker portion is less than the height (measured along arrow "C") of the display unit 122, thereby preventing the display unit 122 from moving, in a direction indicated generally by arrow "B" past the perimetrally extending lip portion 149.

Turning now to FIGS. 3 and 5, one feature of the present invention is that the distal end 112 of the hoop portion 132 is bonded, by a solvent bond 164, to the linearly extending lower portion 104 of the pen barrel 102, so that a "closed loop" is formed by the hoop portion 132.

The solvent used to create the solvent bond 164 is preferably methylene chloride. In the bonding process, the solvent causes the plastic of the pen to partially dissolve or "flow", so that the distal end 112 of the pen will "grab" and securely bond with the radially outwardly facing surface 105 of the generally linear lower portion 104 when the solvent evaporates and the plastic hardens.

Figure 1:
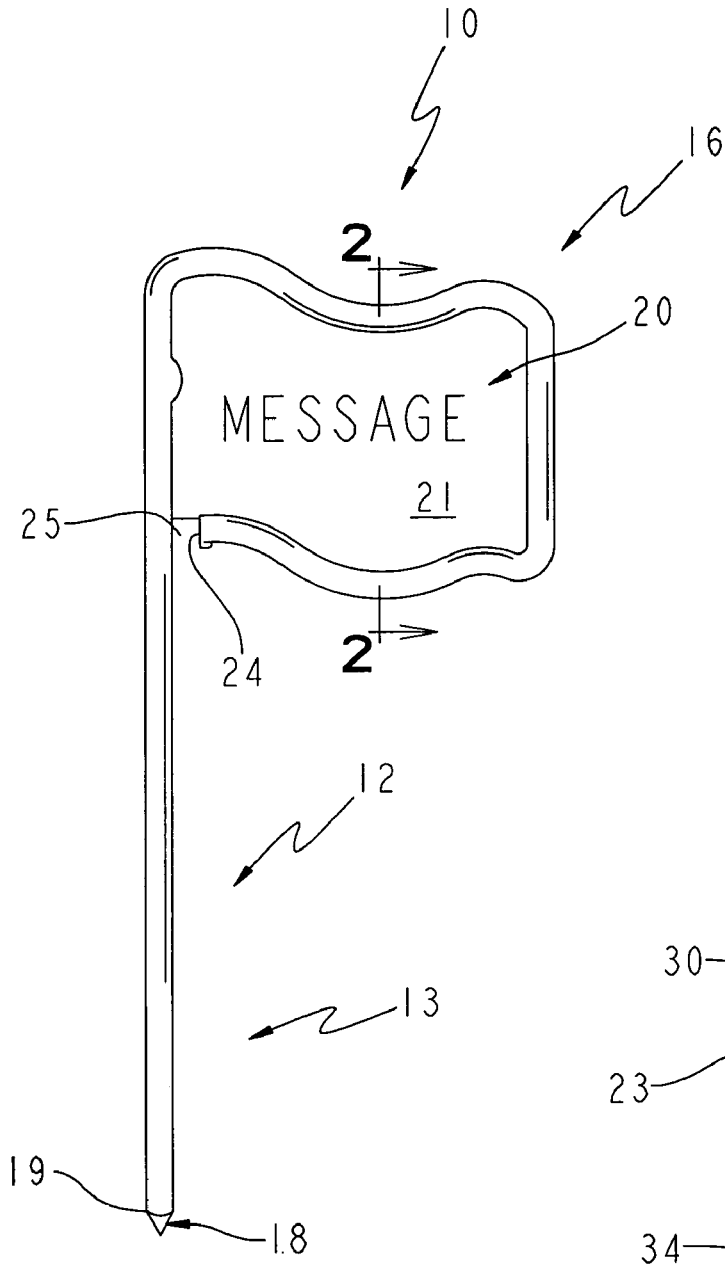
FIG. 1 Prior Art
FIG. 1 is a plan view of a prior art pen.

From a functional standpoint, the importance of the distal end 112 bonding to the radially outward surface 105, is that it provides a more certain, reproduceable, secure and reliable method of securing the display unit 122 onto the hoop 132. In the prior art device (FIGS. 1 and 2), the distal end of the hoop portion was not coupled to the lower portion of the pen, leaving a gap therebetween. With the groove 30 retention mechanism of the prior art, this gap was necessary, as the hoop needed to be spread apart, in order to insert the display unit into the groove 30. However, with the step (lip) and closed loop system of the present invention, the insert can be sized to fit the hoop 132, and inserted onto the hoop 132, and securely retained within the hoop 132.

This secure retention is facilitated by the fact that the bonding 164 of the distal end 112 to the radially outward surface 105 provides a dimensionally stable, and dimensionally reproduceable hoop portion 132, for which a better fitting display unit 122 can be provided. Viewed another way, the secure bond 164 does not suffer the disadvantage of being able to be moved outwardly away from the radially outwardly facing surface 105, to thereby increase the effective diameter of the hoop portion 132. As the diameter of the hoop 132 remains stable and fixed, the display unit 122 is much less likely to become dislodged from the hoop portion 132.

Turning now to FIG. 3, it will be noted that the decorative loop 136 includes a generally small radius of curvature that, in the embodiment pictured in FIG. 3, creates a decorative aperture 172 having a diameter of approximately 3.5 mm. The particular radius of curvature and diameter of the embodiment shown in FIG. 3 are not, in themselves, that crucial to the operation of the writing instrument 100, as the decorative hoop 136 is primarily ornamental. Nonetheless, the small aperture 172 that can be formed is important, as it helps to illustrate the fact that the thinner cross sectional, grooveless hoop structure 132 of the present invention, when compared to the prior art, can be designed and bent to form more intricate shapes than were achievable with the grooved display unit retention system of the prior art.

Additionally, one difficulty encountered by the Applicant, if a design such as that shown in FIG. 3 were attempted, would be to align the groove, so that the portion of the groove on one side of the gap, such as point 179 would line up with the groove on the other side 181 of the gap 183. (Remembering of course, that no groove exists in the embodiment of FIG. 3). With the configuration of the present invention shown in FIGS. 3 and 4, such groove alignment is not necessary, since the groove does not exist. Additionally, it is much easier for the Applicant to align the step ridges at positions 179 and 181 on either side of gap 183. Also, the ridge and lip arrangement of FIG. 3 and 4 provides more forgiving engagement surface, permitting looser tolerances than would be the case if the groove system 30 (FIG. 2) were employed.

Figure 6:
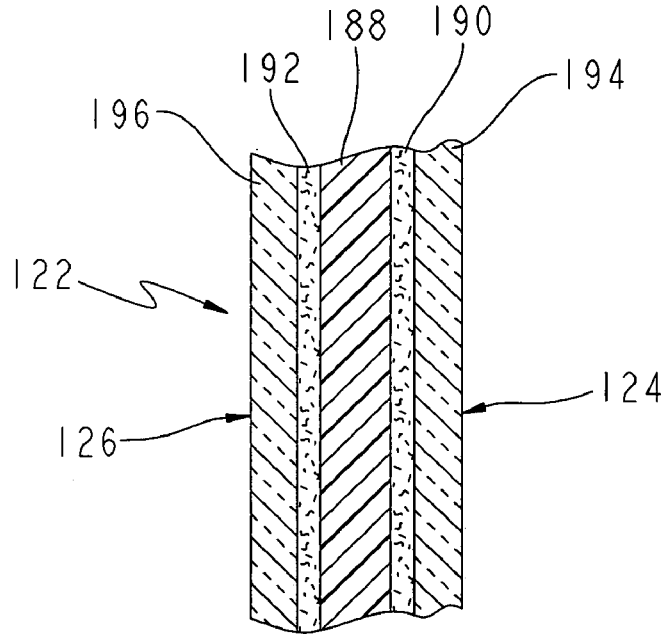
FIG. 6 is a sectional view of the display unit 122 of the present invention.

The construction of the display unit will now be discussed with reference to FIG. 6. Display unit 122 is preferably a five-layer display unit, having a centrally disposed substrate 188 having a first side on which a first layer of ink 190 is deposited, and a second side on which a second layer of ink 192 is deposited.

The substrate 188 is preferably a non-porous material, such as polyester. The particular polyester material is chosen because it has been found that polyester is resistant to melting from the temperature imposed during the thermo-printing process that is preferentially used by the Applicant. Additionally, the polyester substrate 188 is non-porous. It is important to use a non-porous substrate 188, so that the substrate does not wick the solvent used with the ink. If the substrate 188 wicks the solvent, it will pull the solvent up inside the substrate, thereby causing the de-lamination of the first and second vinyl overlay layers 194, 196. Additionally, a porous substrate may cause the ink to dissolve, run or cause other types of damages.

The particular type of ink used is a toner-type ink, that is heat fused to the centrally disposed substrate 188. However, printed wet ink will also do well when applied to the substrate 188. The toner used is generally similar to a toner of the type that may be used in a photocopy machine, or laser printer.

The first and second vinyl overlays 194, 196 are placed over the printed layers 190, 192 respectively. The vinyl layers are generally a little thicker than the ink or substrate layers, to help give the appropriate stiffness and rigidity to the display unit 122. Preferably, the vinyl overlay layers 194, 196 are between about 0.05 and 0.10 mm thick, whereas the substrate 188 is preferably about between 0.04 and 0.07 mm thick.

A vinyl material is used for the overlays 194, 196 because it has been found that other materials do not perform as well. For example, the use of a PCS or styrene layer would likely attack the solvent, thereby causing spotting and damaging and discoloration. Additionally, the vinyl will bond well to the material of the pen member, if such bonding is desired.

Figure 7:
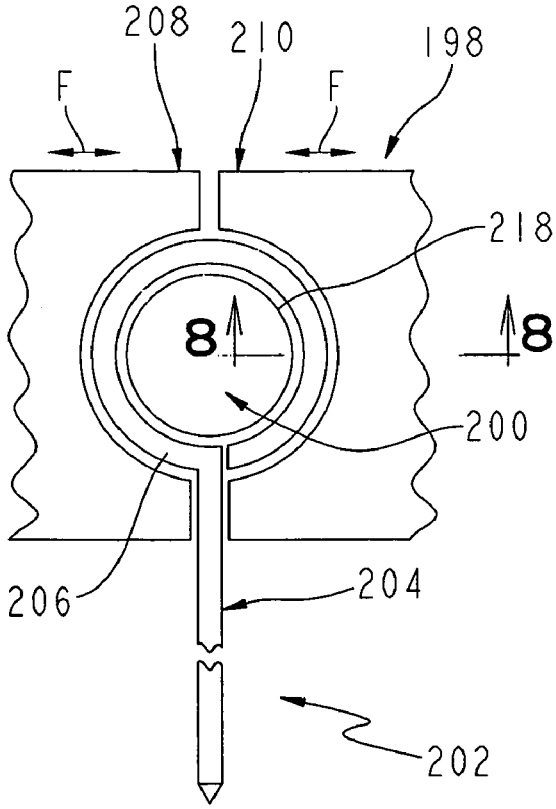
FIG. 7 is a schematic view of the mold assembly used to manufacture a writing instrument of the present invention showing a writing instrument contained on the mold.
Figure 8:
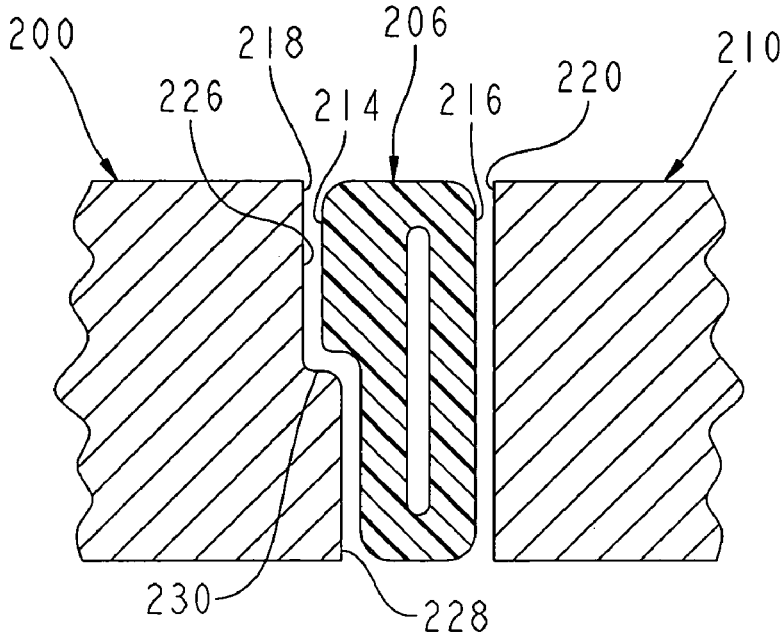
FIG. 8 is a greatly enlarged, sectional view taken along lines 8-8 of FIG. 7.

Turning now to FIGS. 7 and 8, the manufacture of the pen will now be described as follows:

As alluded to above, the pen is manufactured by starting out with a generally linearly, tubular pen blank, such as pen blank 300 shown in FIG. 9. The distal end of the pen blank 300 is heated until the pen blank is pliable. The distal end of the pen blank 300 is then placed in a mold device 198. The mold device 198 includes an interior mold member 200 having a radially outwardly facing surface 218 that has a shape that is configured to be the mirror image of the radially inwardly facing surface 214 of the hoop portion of the pen.

In the embodiment shown in FIG. 7, the radially outwardly facing surface 218 of the interior mold 200 is ring-like to form a ring-like head portion. The distal portion that later becomes the head portion 206 of the pen, after it is heated, is wrapped around the interior mold member 200. By contrast, the linear portion 204 of the pen is generally kept outside of the confines of the mold device 198. After the head portion 206 of the pen 202 is wrapped around the interior mold member 200, the exterior mold members are moved generally in a direction indicated by arrows "F" toward each other, so that the pen engaging, radially inwardly facing surfaces 220 of the exterior mold member 208, 210 are pressed against the radially outwardly facing surface 216 of the head portion of the pen 206. After an appropriate engagement is made, and a suitable dwell time passes, the exterior molds 208, 210 are moved, in the direction indicated generally by arrows "F" away from each other, so that the pen is released and can be removed from its engagement with the interior mold member 200.

During the engagement of the outer molds 208, 210 with the pen 300, enough pressure is exerted on the pen 300 to flatten head portion 206, and to cause the pen to assume the configuration shown in FIG. 8. As best shown in FIG. 8, the radially inwardly facing surface 220 of the exterior mold 210 is generally planar, to form a generally planar, radially outwardly facing surface 216 of the pen. By contrast, the radially outwardly facing surface 218 of the interior mold 200 includes a first portion 226, that, when the pen 300 and mold 210 are engaged, is relatively further spatially separated from the exterior pen-engaging surface 220 of exterior mold 210, so as to form the relatively thickened portion 152 (FIG. 4) of the pen's hoop portion 206, and a second generally planar portion 228 that, when the pen and mold 300, 210 are engaged, is disposed relatively closer to exterior mold 210 to form the relatively thinner portion 156 (FIG. 4) of the pen's hoop portion 206. A step portion 230 of the mold connects the first portion 226 with the second portion 228, to form the step portion 149 of the pen including axially facing surface 151.

When the exterior molds 210, 208 are separated from the interior mold 200 to permit the pen 300 to be released, the pen will assume the shape formed by the molds. After cooling, the pen will continue to assume the same shape. In a later operation, the display insert 122 is added to the head portion 206, and the distal end of the pen is solvent bonded to the adjacent linearly extending portion of the pen, to form the closed loop head portion 206.

Although the invention has been described with reference to the currently perceived best mode of practicing the invention, it will be appreciated by those skilled in the art the variation and modifications exist which are encompassed within the spirit of the invention.

What is claimed is:

1. A writing instrument comprising a colorant dispensing tip;

a barrel having a proximal portion and a distal portion, the proximal portion including a hand-engaging surface and a proximal end coupled to the colorant dispensing tip, the distal portion being unitarily formed with the proximal portion and including a distal end, the distal end being joined to the proximal portion to form a display card receiving closed hoop, the hoop being disposed at a distal most portion of the writing instrument, and a display card, capable of displaying a message, sized and configured for being received by the hoop.

2. A writing instrument comprising a colorant dispensing tip;

a barrel having a proximal portion and a distal portion, the proximal portion including a hand-engaging surface and a proximal end coupled to the colorant dispensing tip, the distal portion being unitarily formed with the proximal portion and including a distal end, the distal end being joined to the proximal portion to form a display card receiving closed hoop, a display card sized and configured for being received by the hoop, and a solvent for joining the distal end to the proximal portion through solvent bonding.

3. The writing instrument of claim 2 wherein includes a perimetral edge and the hoop includes a radially inwardly facing surface for receiving the perimetral edge of the display card.

4. The writing instrument of claim 3 wherein the hoop includes a relatively thicker portion having a first relatively smaller diameter, a relatively thinner portion having a second, relatively larger diameter, and a lip portion extending between the thicker portion and the thinner portion.

5. The writing instrument of claim 4 wherein the display card includes a first face and a second face, and the lip portion includes an axially facing surface for engaging one of the first and second faces of the display card for positioning the display card in the closed hoop.

6. The writing instrument of claim 5 wherein the barrel includes a hollow interior passageway extending substantially throughout the length of the barrel, the passageway being substantially uncompressed in the proximal portion for interiorly receiving an ink cartridge, and being substantially compressed in the distal portion for permitting the distal portion to assume a elatively flattened configuration.

7. The writing instrument of claim 6 wherein the proximal portion is generally linear and the hand-engaging surface comprises a generally cylindrical radially outwardly facing surface.

8. The writing instrument of claim 1 wherein the display card includes a perimetral edge and the hoop includes a radially inwardly facing surface for receiving the perimetral edge of the display card.

9. A writing instrument comprising:

a colorant dispensing tip;

a barrel having a proximal portion and a distal portion, the proximal portion including a hand engaging surface and a proximal end coupled to the colorant dispensing tip, the distal portion being unitarily formed with the proximal portion and including a distal end, the distal end being joined to the proximal portion to form a display card receiving closed hoop a display card sized and configured for being received by the hoop, wherein the hoop includes a relatively thicker portion having a relatively smaller diameter, a relatively thinner portion having a relatively larger diameter, and a lip portion extending between the thicker portion and the thinner portion.

10. The writing instrument of claim 9 wherein the thicker portion includes a first radially inwardly facing surface, the thinner portion including a second radially inwardly facing surface, and the lip portion includes an axially facing surface.

11. The writing instrument of claim 10 wherein the display card includes a first face and a second face, and wherein the axially facing surface of the lip portion engages one of the first and second faces of the display card for positioning the display card interiorly within the hoop.

12. A writing instrument comprising a colorant dispensing tip, a barrel having a proximal portion and a distal portion, the proximal portion including a hand engaging surface and a proximal end coupled to the colorant dispensing tip, the distal portion being unitarily formed with the proximal portion and including a distal end, the distal end being joined to the proximal portion to form a display card receiving closed loop, a display card sized and configured for being received by the loop wherein the barrel includes a hollow interior passageway extending substantially along the length of the barrel, the passageway being substantially uncompressed in the proximal portion for interiorly receiving an ink cartridge, and being substantially compressed in the distal portion to permit the distal portion to assume a relatively flattened configuration.

13. A writing instrument comprising a colorant dispensing tip, a barrel having a proximal portion and a distal portion, the proximal portion including a hand engaging surface and a proximal end coupled to the colorant dispensing tip, the distal portion being unitarily formed with the proximal portion and including a distal end, the distal end being joined to the proximal portion to form a display card receiving closed loop, a display card sized and configured for being received by the loop wherein the display card is disposed at a distal most portion of the writing instrument and includes a non-porous substrate member having a first side surface and a second side surface, a first message printed on the first side surface, a second message printed on the second side surface, a first plastic overlay for overlaying the first message and a second plastic overlay for overlaying the second message.

14. A writing instrument comprising a colorant dispensing tip, a display card; and a barrel having a proximal portion and a distal portion, the proximal portion including a hand-engaging surface and a proximal end coupled to the colorant dispensing tip, the distal portion being unitarily formed with the proximal portion and including a distal end, the distal portion forming a hoop sized and configured for receiving the display card, the hoop including a relatively smaller diameter portion, a relatively larger diameter portion, and a lip portion extending between the smaller diameter portion and the larger diameter portion.

15. The writing instrument of claim 14 wherein the smaller diameter portion comprises a relatively thicker portion, and the larger diameter portion comprises a relatively thinner portion.

16. The writing instrument of claim 15 wherein the thicker portion includes a first radially inwardly facing surface, the thinner portion includes a second radially inwardly facing surface, and the lip portion includes an axially facing surface.

17. The writing instrument of claim 16 wherein the display card includes a first face and a second face, and wherein the axially facing surface of the lip portion engages one of the first and second faces of the display card for positioning the display card interiorly within the hoop.

18. The writing instrument of claim 17 wherein the distal end is bonded to the proximal portion to form a closed hoop.

19. The writing instrument of claim 14 wherein the barrel includes a hollow interior passageway extending substantially along the length of the barrel, the passageway being relatively uncompressed in the proximal portion for interiorly receiving an ink cartridge, and being relatively compressed in the distal portion to permit the distal portion to assure a flattened configuration.

20. The writing instrument of claim 14 wherein the distal end is bonded to the proximal portion to form a closed loop.

* * * * *